United States Patent [19]

Wilson

[11] Patent Number: 4,833,829

[45] Date of Patent: May 30, 1989

[54] GEOMETRIC SLIDING DOOR

[75] Inventor: Robert H. Wilson, Palm Bay, Fla.

[73] Assignee: Viplex Corporation, Melbourne, Fla.

[21] Appl. No.: 231,502

[22] Filed: Sep. 14, 1988

[51] Int. Cl.[4] ..... E05D 15/06

[52] U.S. Cl. ..... 49/426; 49/425; 114/202

[58] Field of Search ..... 49/410, 411, 412, 413, 49/404, 425, 426, 427; 16/98; 114/202; 296/155; 52/66

[56] References Cited

U.S. PATENT DOCUMENTS 1,118,721 11/1914 Wiss ..... 49/426
2,996,844 8/1961 Paulson ..... 49/412

FOREIGN PATENT DOCUMENTS 2112841 7/1983 United Kingdom ..... 296/155

*Primary Examiner*—Kenneth J. Dorner

*Assistant Examiner*—Gerald A. Anderson

[57] ABSTRACT

The present invention relates to sliding doors for closure of entranceways and to companionway entrance closure for watercraft in particular. A sliding plastic door panel is provided and the door panel, being translucent, admits light into the interior of a cabin area. The entire door assembly is mounted on the outside of a boat cabin and does not take up space in the cabin interior, but allows more usable cabin space within.

Upper and lower plastic tracks are provided for movement of plastic roller trucks therein. The door panel, the two open tracks and the roller assembly are non metallic and non-corroding and the rollers do not require lubrication. The door panel and other parts do not require painting and provide a track and roller arrangement in which the weight of the sliding door panel is directed downward against the bottom of the track, and provides a sliding door that is smooth and easy to use in operation, and very attractive in appearance.

10 Claims, 1 Drawing Sheet

GEOMETRIC SLIDING DOOR

This application is a continuation of application Ser. No. 037,993, filed 4/14/87.

FIELD OF THE INVENTION

The invention relates to the field of sliding doors in general and to sliding companionway doors for use with watercraft, in particular.

BACKGROUND OF THE INVENTION

The use of companionway closures is a very old art and has been commonlyused in boat designs for boats of many types. The usual and customary type of doors are constructed in three parts, on smaller vessels such as is contemplated by the present invention, two swinging doors, each one mounted on opposite sides of the companionway passage, are joined with the edges together when the doors are in a closed position. A third panel is hinged above to move vertically, raised up when in the open position, and lowered down to meet with the upper edges of the lower swinging doors, when in the closed position. This type of closure is traditional, but presents a number of serious problems and requires continous maintenance. The traditional door described is usually fabricated of teak wook and although generally attractive in appearance, does not seal well against water leakage, is slow and clumsy to use, requires a wider companionway to accomodate the swinging doors, and requires a frequent re-varnishing of the wood to maintain an attractive appearance. An additional disadvantage present is that such traditional doors usually do not admit light, resulting in a darkened cabin when the doors are closed. Other problems are present, such as: Corrosion of metal hinges and other hardware and latches used to keep the doors in an open position or in a closed position.

By contrast, the present invention effectively eliminates many of the above problems. By sliding to the side of the companionway entrance, the single panel of the present invention eliminates the usual hinges, and being installed outside of the companionway, permits a more narrow passageway to be used. The angled upper portion of the panel of the present invention eliminates the need of a hinged upper panel such as found in the traditional type of door. The use of a plastic doorpanel eliminates re-varnishing problems, the resilient seal of the present invention eliminates leakage problems, and the translucent properties of the plastic sliding door panel eliminates the lack of light within the cabin structure. The extruded plastic channel rails together with the plastic roller wheels presents practical hardware that is truly non-corrosive.

Although the present invention employs some of the features that are common to the prior art, the novel arrangement of the various components thereof presents a novel and effective construction arrangement for a sliding companionway entrance closure.

The present invention provides a single panel sliding door that is of substantially heavy plastic material. The panel is substantially vertical at the lower portion, an upper portion extending away from the vertical portion at an angle. An open plastic track is provided at the lower edge to receive low-friction rollers that are mounted at the lower edge of the door panel. A second open track is mounted at the upper end of of the angled portion to receive additional low-friction rollers mounted at the edge of the upper portion of the panel, thereby providing low-friction support to both the lower edge of the door panel and to the upper portion.

A resilient and easily compressible seal is mounted between the cabin structure and the sliding door panel to seal against water, such as rain, spray, and breaking waves, as well as dust and undesireable noise. The seal is of a soft low-friction plastic material, and like the other major component parts of the present invention, is non-corrodable.

A recent search of the patent office prior art of record produced the following references:

U.S. Pat. No. 2,569,763 by Hofferberth teaches a top-opening cold box with horizontally sliding doors, however, the device has two doors, both of which are flat on a single plane, and neither of which extend into a verticle plane, and does not disclose the construction of the present invention.

U.S. Pat. No. 4,335,547 by Maxwell discloses a structure, that upon first glance, resembles the present invention but unlike the present invention, the Maxwell structure has rollers only at the bottom and not at the top. Furthermore, the Maxwell structure has side panels, not included in the present invention, as well as multiple panels on the other surfaces. The structure is that of a laterally movable green house that can also serve as a solarium. This patent does not teach or disclose the arrangement or construction of the present invention.

U.S. Pat. No. 4,381,629 by Ahn discloses a green house with an angular sliding roof. Unlike the present invention, this structure has two angular top surfaces that do not extend downward into a verticle panel and all rollers are positioned at the top of the sidewalls. This reference also does not teach or disclose the arrangement or structure of the present invention.

U.S. Pat. No. 2,613,844 by Mounce discloses an open top display box that bears some resemblance to the present invention. The disclosure, however, teaches a structure having one horizontally sliding closure that moves away from the front of the structure rather than laterally as provided in the present invention. The angled front panel of the Mounce structure is fixed and does not move.

Numerous other patents disclose various methods or hardware for construction of flat plant verticle sliding doors, but not teaching, disclosing or anticipating the construction of the present invention are found. Examples are:

U.S. Pat. No. 2,507,497 by Bowers,
U.S. Pat. No. 3,946,524 by Budich,
U.S. Pat. No. 2,659,939 by Grieg,
U.S. Pat. No. 3,425 162 by Halpern,
U.S. Pat. No. 2,704,866 by Grossman,
U.S. Pat. No. 2,627,092 by Grossman,
U.S. Pat. No. 2,599,747 by Craigon,
U.S. Pat. No. 1,181,331 by Metzger, Of greater interest is U.S. Pat. No. 2,646,949 by Saulnier. This patent discloses a sliding canopy for aircraft that extends over the cockpit and passenger seating compartment in a manner somewhat similar to the present invention. Unlike the present invention, the angled canopy does not extend into a verticle form as it is intended for occupants to climb down into the aircraft, rather than to walk in as into a water-craft companionway entrance. Unlike the present invention, the canopy is removable or may be jetisoned in flight. The Saulnier device is also moved from an open position to a closed position by the use of crank operated apparatus, and is further absent the low-friction rollers at the upper section as provided by the present invention.

As demonstrated by the foregoing, it becomes readily apparent that the present invention presents a novel and useful departure from the prior art as will be better understood from reading of the summary and detailed description that follow.

SUMMARY OF THE INVENTION

The primary object of the present invention is to provide a more versatil and innovative closure for companionway entrances on watercraft and to eliminate many of the problems that are commonly found in traditional designs. The present invention with the novel single panel, together with the upper and lower tracks and low-friction rollers, the upwardly facing, open tracks, together with the downwardly directed rollers, provide that the weight of the door panel and other downward pressures are directed against the interior bottom surface of the tracks and effectively eliminate distortion of the tracks. The tracks are extruded in a shape that provides an interior lip that conforms to the configuration of the rollers and prevents any upward dislodgement of the rollers from the tracks. The use of multi-wheel roller trucks which are rigidly connectd with the sliding panel, insures proper alignment of the door panel with the tracks and effectively eliminates binding of the door with the tracks, when the door panel is moved from either an open position or a closed position. The roller wheels fit on to the axels of the truck in such a manner that the roller wheels are held securely in place by the interior side-walls of the tracks and the need for screws, nuts, or keepers is thereby eliminated entirely. The extensive and almost exclusive use of plastic parts eliminates metal corrosion. As the plastic roller wheels and the plastic axels require no lubricant, the need for bushings, or bearings is also eliminated.

For optimum results, the present invention is an arrangement best suited for a boat manufacturer that uses a precision mold to form the companionway entrance for boats. The use of such a mold insures uniformity in the configuration and dimensions of the entrance. The present invention door panel and all component parts are then made to conform precisely to the molded entrance and delivered to the boat manufacturer. By this method, the need of fitting each doorway to each boat is very effectively eliminated and much time and labor is saved by this proceedure. A further and very important advantage is derived as the molded glass-resin doorway is not absolutely rigid and will not crack under normal flexing of the boat structure. The novel design of the present invention door system is such as to allow for such normal flexing of the boat structure, without damage to the door system.

Accordingly, it is a primary object of the present invention to provide a sliding door that will be attractive in appearance, that will move smoothly and freely with less effort, and that will cause a boat in which it has been installed to be much more marketable.

It is a further object of the present invention to provide a closure for a companionway entrance that does not extent into the interior of the companionway and does not take up space within the companionway.

It is a still further object of the present invention to provide a sliding door wherein low-friction rollers are mounted at both the upper and lower ends.

It is still another object of the present invention to provide a sliding door having upper and lower low-friction rollers that are downwardly directed so as to better bear the weight and downward pressures in a more efficient manner.

It is still another object of the present invention to provide the two upwardly facing open tracks wherein the upper and lower roller wheels bear against the bottom surface of the tracks.

It is still another object of the present invention to provide novel wheel and axle arrangement where the wheels and axles are held securely together by the interior side-walls of the tracks.

It is a still further object of the present invention to provide the interior retaining ledge to avoid dislodgement of the roller wheels in an upward direction.

It is a still further object of the present invention to provide roller wheels and axles that do not require lubrication.

It is a still further object of the present invention to provide a sliding door arrangement wherein most component parts are fabricated of a non-corroding material.

It is another object of the present invention to provide an efficient seal to prevent the entrance of water, dust, and other contaminants.

It is still another object of the present invention to provide a sliding door panel for watercraft that is translucent to avoid a darkened cabin area.

It is another object of the present invention to provide an open end roller track that will allow efficient draining of water.

The invention will be better understood after reading the following detailed description of the embodiments thereof with reference to the appended drawings, in which:

DETAILED DESCRIPTION

Figure 1:
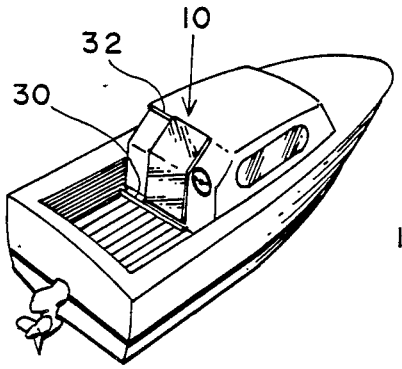
FIG. 1 is a perspective view of a typical small power boat with the sliding door installed.

Referring to the drawings by characters of reference, FIG. 1 illustrates a typical small power boat with sliding door 10 of the present invention, mounted thereon, and the upper track 32, and the lower track 30, shown extending beyond the door panel.

Figure 2:
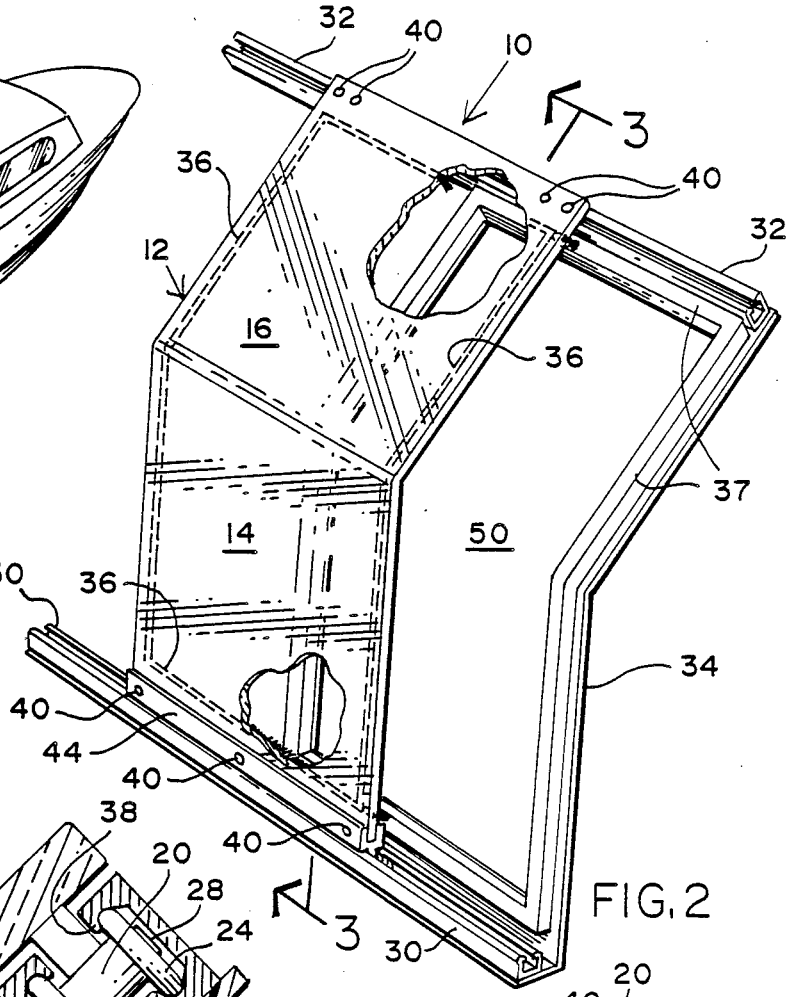
FIG. 2 is a perspective view of the door as mounted on a boat.

FIG. 2 is a perspective view showing the door panel 12 mounted against the cabin structure wall 34. The lower portion 14 of the door 12, is, in the preferred embodiment, a flat and substantially vertical panel. The lower edge of the lower panel 14 is mounted in the slotted train body 44 and secured therein by the screws 40. The train body 44 extends downwardly into the open track 30 and is attached to the roller trucks 18 by the screw 46. A roller truck 18 is moutned at each end of the train body 44 (see FIG. 3 and FIG. 5). The upper portion 16 of the door panel 12 extends away from the verticle lower portion 14 upwardly, the uppermost edge terminating adjacent to the upper open track 32. A roller truck 20 (see FIG. 4) is mounted against the underside of upper panel portion 16 at each end of thereof and secured by the screws 40. The lower open track 30 is mounted at the lower edge of the entrance 50 and the upper track 32 is mounted at the upper edge of the entance 50, both upper track 32 and lower track 30 being parallel with the upper and lower edges of the entrance 50 and also parallel with each other, the sliding door 12 is easily and smoothly moved from either an open or closed position. To prevent the entrance of undesirable rain, dust, and other foreign objects from the interior of the cabin area, a seal 36 is inletted into the under surface of the door panel 12. The seal 36 extends around the entire perimeter of the door 12 and when the door 12 is in the closed position, seal 36 is in contact with the sealing contact surface 37, sealing contact surface 37 having been molded into the entrance structure by the boat manufacturer.

Figure 3:
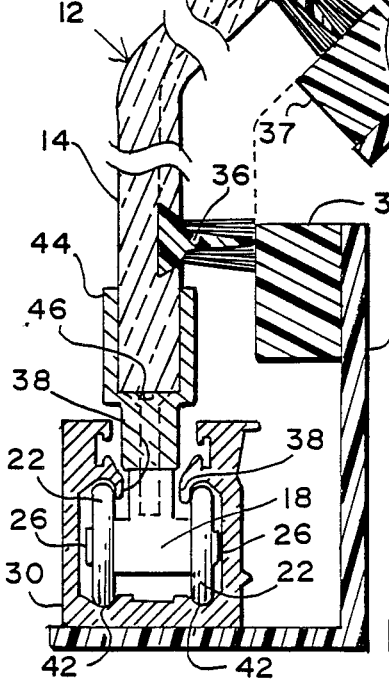
FIG. 3 is a cross sectional view of the sliding door panel, the upper and lower tracks, the roller wheels and trucks, the seal, and a portion of the cabin structure.

Turning now to FIG. 3, a cross sectional view shows the door panel portions in detail. The lower panel portion 14 is mounted in train body 44, train body 44 extending downwardly into open track 30 and fastened to roller truck 18 with screw 46. Roller wheels 22 are mounted on axles 26 of roller truck 18 roller wheels 22 being positioned in grooves 42 of track 30, the retaining ledges 38 preventing upward dislodgement of roller wheels 22 from the confines of track 30. The seal 36, mounted on the inner surface of sliding door panel 12, bears against the sealing contact surface 37, sealing contact surface 37 being mounted on or forming a part of cabin wall structure 34. The upper portion 16 of door panel 12 extends above the open track 32. The upper roller truck 20 is fastened to the underside of upper panel portion 16 for movement within upper open track 32 and the roller wheels 24 are secured against upward dislodgement by the retaining ledges 38. The roller wheels 24 are rotatable on axles 28 of roller truck 20.

Figure 4:
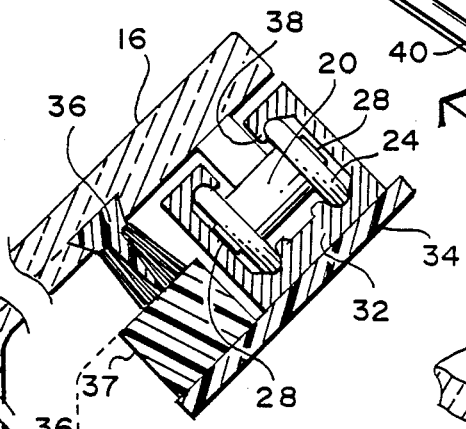
FIG. 4 is a perspective cross sectional view of the upper track, the roller truck mounted therein, and a portion of the door panel with a portion of the seal mounted in the panel portion.
Figure 4:
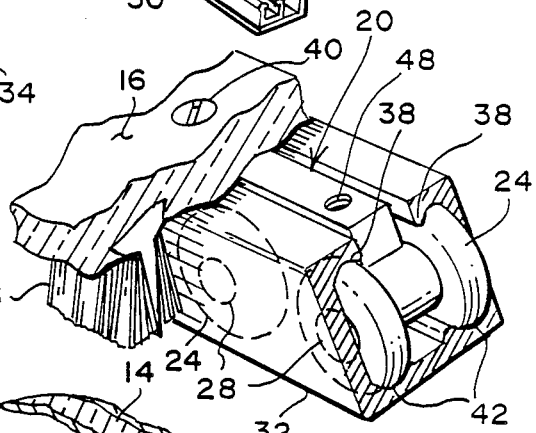

Turning now to FIG. 4, a perspective and sectional end view is presented showing a segment of the upper portion 16 of the door panel 12, attached to the upper roller truck 20 by the screw 40. A segment of the seal 36 is also shown. The roller wheels 24 mounted on axles 28 (shown in phantom), move in the grooves 42 and are retained by the retaining ledges 38. The threaded hole 48 is provided to receive an additional screw 40 which is not shown.

Figure 5:
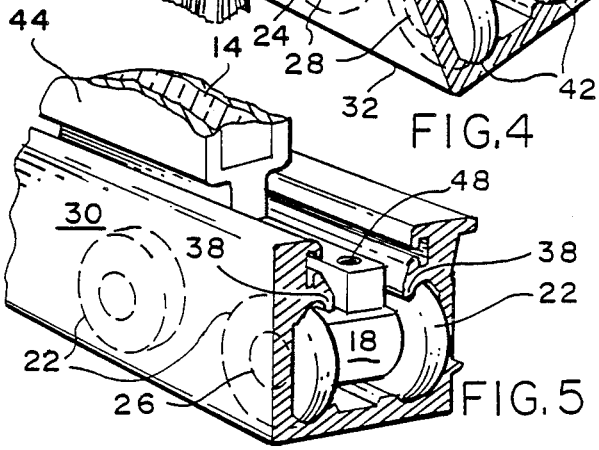
FIG. 5 is a perspective cross sectional end view of the lower track with the roller truck in place, and a small portion of the lower door panel and a small prtion of the train body to which the roller truck is attached.

FIG. 5 is also a perspective end view and shows details of the lower open track 30, the lower roller truck 18 and a portion of the lower potion 14 of door panel 12 mounted in a section of train body 44. The description of this part of the door assembly would be the same as that given in the description of FIG. 3 with the exception that in FIG. 5, the roller truck assembly is shown as not connected to the train body 44 and is shown as protruding slightly from open track 30 for clarity of detail.

Figure 6:
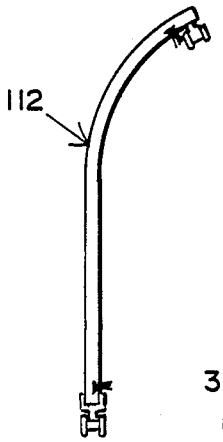
FIG. 6 is an end view of a variation of the door panel showing that the upper portion of the door panel may be curved.

FIG. 6 illustrates a variation of the invention. Although the drawings illustrate an angled upper portion of the sliding door panel 12, the configuration of the upper portion will be governed by the actual shape of the cabin structure of any boat on which the door will be used. Therefore, the angle of the upper portion will vary in relation to the lower portion, in accordance with the particular design of various boats. The contour of a companionway entrance may be such as require a panel that is curved, ratther than angled. It is not intended to restrict or confine the invention to an angled panel, but to include a panel having a curved shape. FIG. 6 shows a sideend view of such a curved panel.

Having described the presently preferred embodiments of the invention, it should be understood that various changes in construction and arrangement will be apparent to those skilled in the art and are fully contemplated herein without departing from the true spirit of the invention. Accordingly, there is covered all alternatives, modifications and equivalents as may be included within the spirit and scope of the invention as defined in the appended claims.

What is claimed is:

1. A sliding door for a companionway entrance in a cabin wall of a watercraft comprising:

a door panel for slidingly covering or uncovering said companionway entrance having a lower portion of said door panel extending upwardly from a lower track, said lower track mountd to a deck surface of said watercraft and extending at least along a bottom edge of said entrance, lower roller means, said lower roller means being operative with said lower track, said lower roller means being connected to the bottom edge of said door panel, said lower roller means having at least one roller and a roller axis normal to the lower portion of said door panel and engaging said lower track, an upper portion of said door panel diverging from the plane of said lower portion of said door panel, upper roller means connected to an inside surface of said upper portion of said door panel for operative engagement with an upper track, said upper track being mounted to said cabin wall and extending at least along an upper edge of said entrance, said upper track being positioned adjacent to the end of said upper portion of said door panel and said upper roller means having at least one roller, said roller having an axis at an angle acute or obtuse to said lower roller means axis, said tracks and said roller means providing support to said door panel while minimizing friction for sliding of said door panel, said tracks including retaining means to prevent dislodgement of said roller means either as a result of movement of the watercraft on water or from manually operating the door panel, by thrust against the inside or outside surface of the door panel.

2. The sliding door assembly of claim 1 further comprising sealing means for sealing against entry of water, dust, and other contaminates.

3. The sliding door assembly of claim 1 wherein said door panel conforms to the profile of an entranceway to which said door panel is mounted.

4. The sliding door assembly of claim 1 wherein said lower portion of said door panel is planar.

5. The sliding door assembly of claim 1 wherein said upper portion of said door panel is planar.

6. The sliding door assembly of claim 1 wherein said lower portion of said door panel is curved.

7. The sliding door assembly of claim 1 wherein said upper portion of said door panel is curved.

8. The sliding door assembly of claim 1 wherein said lower portion of said door panel is verticle.

9. The sliding door assembly of claim 1 wherein said lower portion of said door panel is angled.

10. The sliding door assembly of claim 1 wherein said open tracks, said roller means, said door panel, are made of plastic material.

* * * * *